US006047539A

United States Patent [19]

Farmer

[11] Patent Number: 6,047,539

[45] Date of Patent: Apr. 11, 2000

[54] METHOD OF PROTECTING GAS TURBINE COMBUSTOR COMPONENTS AGAINST WATER EROSION AND HOT CORROSION

[75] Inventor: Gilbert Farmer, Cincinnati, Ohio

[73] Assignee: General Electric Company, Cincinnati, Ohio

[21] Appl. No.: 09/070,053

[22] Filed: Apr. 30, 1998

[51] Int. Cl.[7] ..... F02G 3/00

[52] U.S. Cl. ..... 60/39.02; 60/39.55; 60/753

[58] Field of Search ..... 60/39.02, 39.05, 60/39.55, 753

[56] References Cited

U.S. PATENT DOCUMENTS

| | | | |
|---|---|---|---|
| 2,476,185 | 7/1949 | Goddard | 60/39.55 |
| 4,382,771 | 5/1983 | Carr | 60/39.55 |
| 4,397,356 | 8/1983 | Retallick | 60/39.55 |
| 4,455,839 | 6/1984 | Wuchter | 60/753 |
| 4,567,730 | 2/1986 | Scott | 60/757 |
| 4,655,044 | 4/1987 | Dierberger et al. | 60/753 |
| 5,009,070 | 4/1991 | Iizuka et al. | 60/753 |
| 5,073,433 | 12/1991 | Taylor | 428/134 |
| 5,113,660 | 5/1992 | Able et al. | 60/752 |
| 5,220,786 | 6/1993 | Campbell | 60/39.32 |
| 5,528,904 | 6/1996 | Jones et al. | 60/753 |
| 5,553,455 | 9/1996 | Craig et al. | 60/753 |

*Primary Examiner*—Charles G. Freay
*Attorney, Agent, or Firm*—Andrew C. Hess; Rodney M. Young

[57] ABSTRACT

A method of preventing water erosion and hot corrosion in a combustor of a gas turbine engine, wherein water is injected into said combustor for NOx abatement, which involves the step of applying a dense vertically cracked thermal barrier coating to certain components thereof The dense vertically cracked thermal barrier coating has a porosity of less than approximately 8% and a tensile strength in the range of approximately 4–7 ksi. The dense vertically cracked thermal barrier coating is applied to such combustor components so as to produce a segmented ceramic structure having macrocracks formed therein which are oriented substantially perpendicular to an interface of the combustor component and the segmented ceramic structure.

20 Claims, 3 Drawing Sheets

METHOD OF PROTECTING GAS TURBINE COMBUSTOR COMPONENTS AGAINST WATER EROSION AND HOT CORROSION

BACKGROUND OF THE INVENTION

1. Field of the Invention

The present invention relates generally to a combustor for a gas turbine engine having water injection for NOx abatement and, in particular, to a method of protecting selected components of such combustor from the effects of water erosion and hot corrosion.

2. Description of Related Art

It is well known that the combustor of a gas turbine engine is subjected to extreme temperatures during operation, perhaps as high as 3500° F. Accordingly, several measures have been employed in the art to protect combustor components against thermal shock and high thermal stresses. These include the use of new and exotic metal alloys, various heat shield configurations, cooling schemes and certain types of thermal barrier coatings as demonstrated by U.S. Pat. No. 5,553,455 to Craig et al., U.S. Pat. No. 5,528,904 to Jones et al., U.S. Pat. No. 5,220,786 to Campbell, U.S. Pat. No. 4,655,044 to Dierberger et al., and U.S. Pat. No. 4,567,730 to Scott.

Another consideration involved with the design of gas turbine combustors is the ability to minimize emissions therefrom. In the case of marine and industrial applications, this has typically been accomplished through the injection of water into the combustor to reduce the temperature therein (e.g., through the nozzle circuit utilized for supplying fuel). It has been found, however, that such water injection has had the undesirable effect of causing metal distress and erosion to certain components of the combustor due to cavitation and impingement. The particular combustor components concerned may vary depending upon combustor design and exactly where impingement of the water takes place. It will be understood, however, that water is more punitive than other fluids passing through the combustor, such as liquid fuel and steam, because it has a higher coefficient of convective heat transfer and, all else being equal, causes higher thermal stress.

While some attempts have been made to solve both the thermal and erosion problems set forth above, such as in the Campbell patent, it will be noted that none of the heat shields employed have been subjected to water impingement. Thus, in light of the foregoing, it would be desirable for a new and improved method of protecting combustor components against water erosion and hot corrosion to be developed.

SUMMARY OF THE INVENTION

In accordance with a first aspect of the present invention, a method of preventing water erosion and hot corrosion in a combustor of a gas turbine engine is disclosed, wherein water is injected into the combustor for NOx abatement, which involves the step of applying a dense vertically cracked thermal barrier coating to certain components thereof. The dense vertically cracked thermal barrier coating has a porosity of less than approximately 8% and a tensile strength in the range of approximately 4–7 ksi. The dense vertically cracked thermal barrier coating is applied to such combustor components so as to produce a segmented ceramic structure having macrocracks formed therein which are oriented substantially perpendicular to an interface of the combustor component and the segmented ceramic structure.

In accordance with a second aspect of the present invention, a combustion apparatus for a gas turbine engine is disclosed as including a combustor structure having at least one combustion chamber, a dual cone fuel nozzle for injecting both fuel and water to the combustion chamber, and a swirl cup package upstream of and adjacent to the combustion chamber. The swirl cup package further includes a swirler, a swirl cup, a splashplate, and a venturi extending between the nozzle and the combustion chamber for mixing the fuel and water with air. A dense vertically cracked thermal barrier coating is applied to selected portions of the swirl cup package so as to prevent water erosion and hot corrosion, the particular swirl cup portions being selected depending upon where a fuel/water cone strikes therein.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INJECTION

Figure 1:
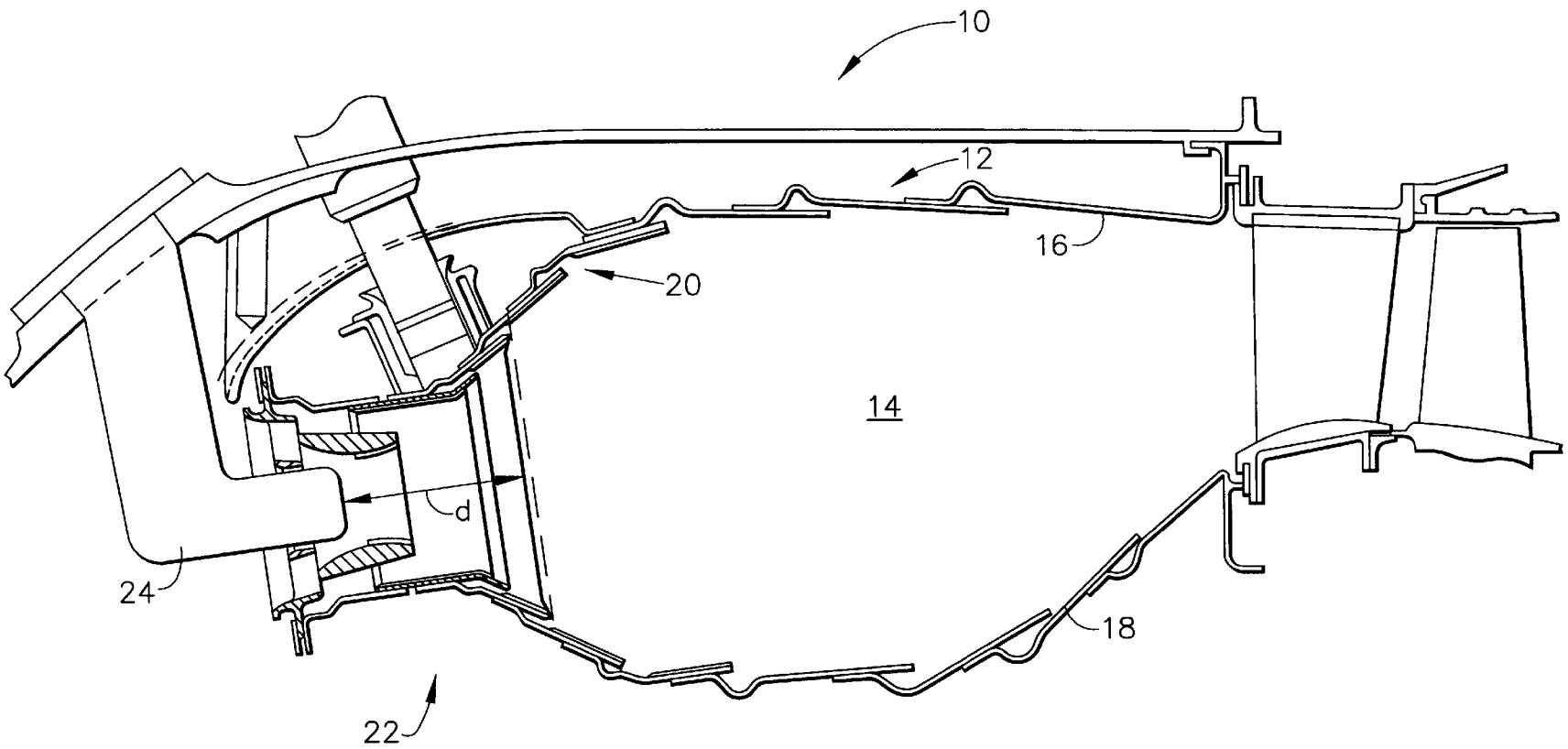
FIG. 1 is a partial cross-sectional view through a single annular combustor structure in accordance with the present invention.

Referring now to the drawings in detail, wherein identical numerals indicate the same elements throughout the figures, FIG. 1 depicts a cross-sectional view of a continuous burning combustion apparatus 10 of the type suitable for use in a gas turbine engine and comprises a hollow body 12 which defines a combustion chamber 14 therein. Hollow body 12 is generally annular in form and is comprised of an outer liner 16, an inner liner 18, and a domed end or dome 20. It should be understood, however, that this invention is not limited to such an annular configuration and may well be employed with equal effectiveness in combustion apparatus of the well known cylindrical can or cannular type. In the present annular configuration, domed end 20 of hollow body 12 includes a swirl cup package 22, where certain components of combustor 10 are prepared in accordance with the present invention so as to allow the injection of water into combustion chamber 14 without causing thermal stress and water erosion thereto.

FIG. 1 also depicts a fuel nozzle 24 inserted into swirl cup package 22. Fuel nozzle 24 preferably is a dual cone fuel nozzle, whereby both fuel and water may be provided to combustion chamber 14. In this way, fuel may be ignited in combustion chamber 14 while water reduces the temperature, and consequently, emissions therein. It will be noted in FIG. 1 that fuel nozzle 24 may be spaced a distance d from combustion chamber 14 in order to prevent carbon clusters from forming on the tip surfaces of nozzle 24 resulting from close proximity to combustion chamber 14.

Figure 2:
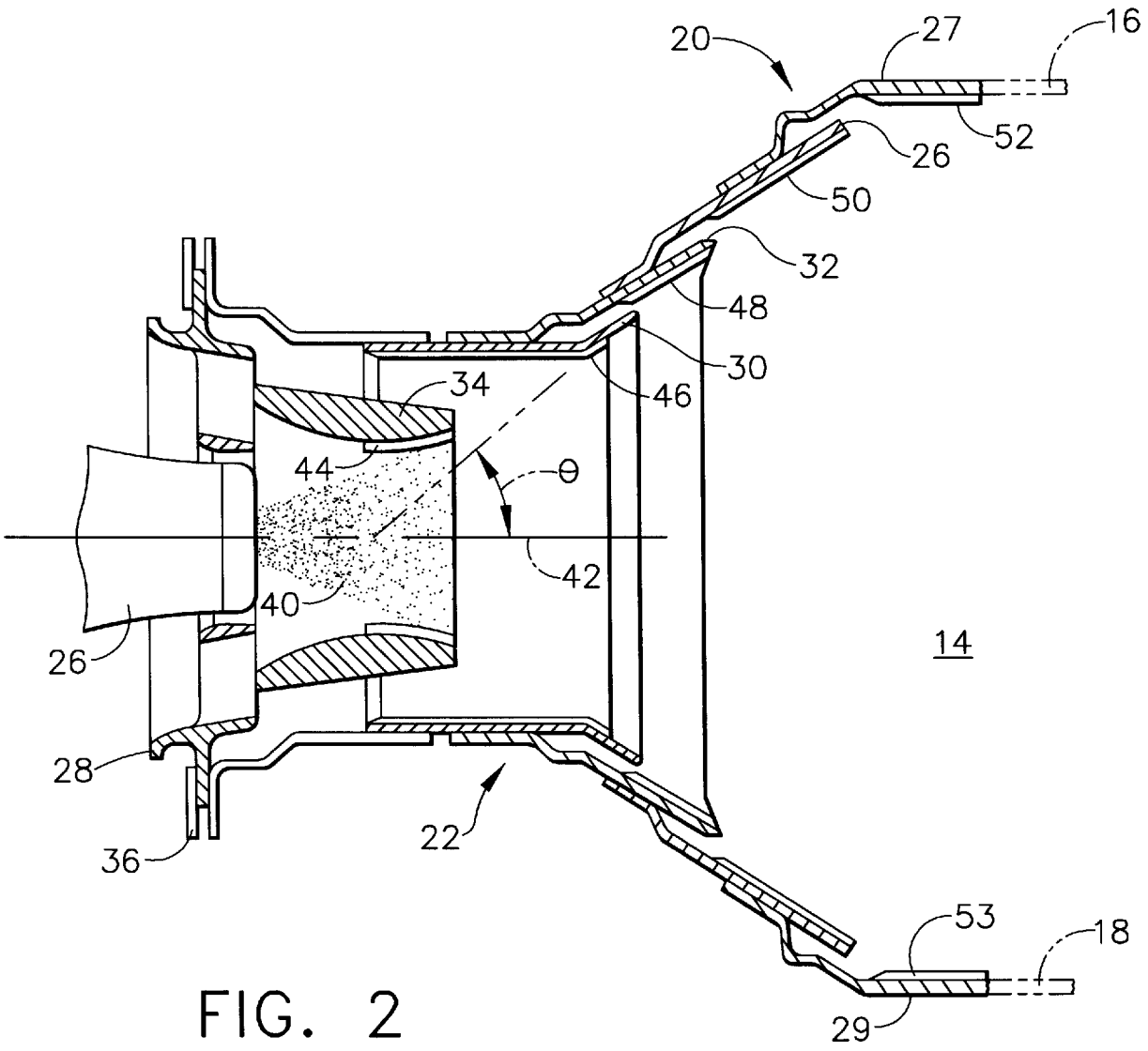
FIG. 2 is an enlarged, partial cross-sectional view of the swirl cup package and combustor dome portion depicted in FIG. 1, wherein application of a dense vertically cracked thermal barrier coating to certain components thereof is shown.

As best seen in FIG. 2, combustor dome 20 consists of a single spectacle plate 26, which is generally a die formed sheet metal part. Outer and inner rivet bands 27 and 29, respectively, are provided to connect spectacle plate 26 to outer liner 16 and inner liner 18. An individual swirl cup package 22 is brazed into spectacle plate 26 and includes therein a swirler 28, a swirl cup 30, a splash plate (or trumpet) 32, and a venturi 34. Swirl cup assembly 22 preferably is brazed together with a retainer 36 welded into position on the front surface of swirler 28.

FIG. 2 also illustrates the injection of water and fuel into venturi 34, whereupon it is caused to swirl in a frusto-conical manner 40 by air flow through the inner portion of swirler 28. Depending upon the length of venturi 34 along a longitudinal axis 42 running therethrough, as well as an angle θ formed between spectacle plate 26, the downstream lip of splash plate/trumpet 38, and the downstream lip of swirl cup 30 with respect to axis 42 due to the distance d between fuel nozzle 24 and combustion chamber 14, one or more of the combustor components may be impacted by fuel/water cone 40 besides venturi 34. As noted hereinabove, the relatively cold water (e.g., approximately 100° F.) not only causes thermal distress, but also erosion and fragmentation stemming from cavitation and impingement.

In order to overcome these problems, the applicable components have a dense vertically cracked thermal barrier coating applied to the pertinent portions thereof as identified by numerals 44, 46, 48, 50, 52 and 53, respectively. While the thermal barrier coating utilized is not new in and of itself (see, e.g., U.S. Pat. No. 5,073,433 to Taylor, which is hereby incorporated by reference), it has been found that this particular type of thermal barrier coating has a greater resistance to particle erosion and thermal strain than those previously employed in gas turbine engine combustors, which is particularly advantageous in the wet (or water injection) environment. This stems from the dense vertically cracked thermal barrier coating having a porosity of less than approximately 8% and a tensile strength in the range of approximately 4–7 ksi (as opposed to standard thermal barrier coatings having a relatively weak and soft ceramic top coating structure containing 15–25% porosity and a tensile strength in the range of 1–2 ksi).

Figure 3:
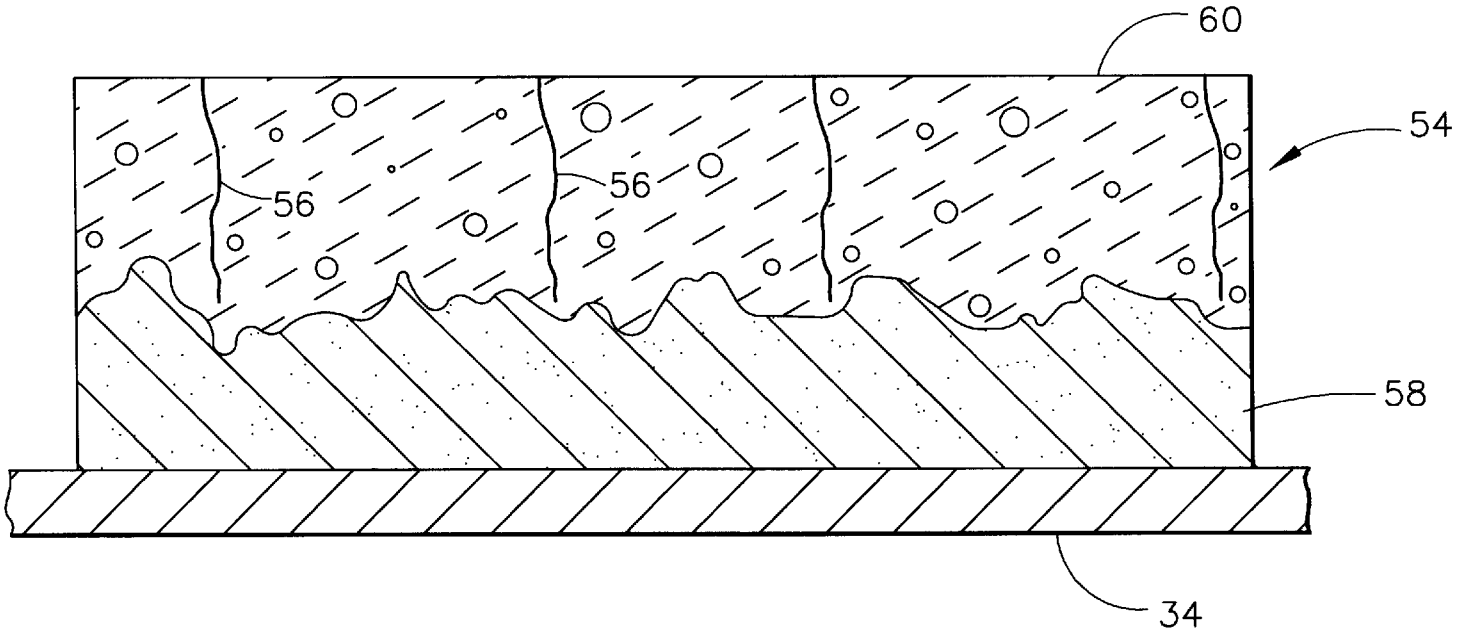
FIG. 3 is an enlarged, partial diagrammatic view of the dense vertically cracked thermal barrier coating applied to a portion of a combustor component.

It will further be understood that spraying procedures are selected for the dense vertically cracked thermal barrier coating which produce a segmented ceramic structure 54 as seen in FIG. 3. Segmented ceramic structure 54 serves as an effective strain release mechanism for the metallic/ceramic interface between combustor components and the dense vertically cracked thermal barrier coating, where macrocracks 56 (defined in the art as cracks greater than 5 mils) are preferably produced at a density of about 20–300 per inch and oriented substantially perpendicular to the metal surface of the combustor component (shown in FIG. 3 as venturi 34).

The dense vertically cracked thermal barrier coating utilized has a metallic bond coat 58 and a ceramic top coat 60, where metallic bond coat 58 preferably is made of a Nickel Chromium alloy (e.g., NiCrAlY) and ceramic top coat 60 is made of Zirconia-8% Yttria In operation, compressed air from a compressor (not shown) is injected into the upstream end of swirl cup package 22 where it passes through swirler 28 and enters venturi 34. Fuel and water are injected into venturi 34 via nozzle 24. At the downstream end of swirl cup package 22, fuel/water mixture 40 is supplied into a mixing region of combustor chamber 14 which is bounded by inner and outer liners 18 and 16. Fuel/water mixture 40 is then mixed with recirculating hot burnt gases in combustion chamber 14. In light of the improvements made to the components of combustor 10 by application thereto of the dense vertically cracked thermal barrier coating described herein, however, the concerns of resisting water erosion and hot corrosion caused by impingement of the fuel/water mixture are met.

Having shown and described the preferred embodiment of the present invention, further adaptations of the dense vertically cracked thermal barrier coating within the water-injected gas turbine combustor environment can be accomplished by appropriate modifications by one of ordinary skill in the art without departing from the scope of the invention.

What is claimed is:

1. A method of preventing water erosion and hot corrosion in a combustor of a gas turbine engine, wherein water is injected into said combustor for NOx abatement, comprising the step of applying a dense vertically cracked thermal barrier coating to components of said combustor subject to impingement by said water.

2. The method of claim 1, wherein said dense vertically cracked thermal barrier coating has a porosity of less than approximately 8%.

3. The method of claim 1, wherein said dense vertically cracked thermal barrier coating has a tensile strength in the range of approximately 4–7 ksi.

4. The method of claim 1, wherein said dense vertically cracked thermal barrier coating is a segmented ceramic structure.

5. The method of claim 4, wherein macrocracks are produced within said segmented ceramic structure so as to be oriented substantially perpendicular to an interface of said designated combustor component and said segmented ceramic structure.

6. The method of claim 5, wherein said macrocracks are produced within said segmented ceramic structure at a density of approximately 20–300 per inch.

7. The method of claim 1, wherein said designated combustor component is a venturi.

8. The method of claim 1, wherein said designated combustor component is a splash plate.

9. The method of claim 1, wherein said designated combustor component is a spectacle plate.

10. The method of claim 1, wherein said designated combustor component is a swirl cup.

11. The method of claim 9, wherein said designated combustor component is a rivet band connecting said spectacle plate to a liner.

12. The method of claim 1, said dense vertically cracked thermal barrier coating further comprising a metallic bond coat and a ceramic top coat.

13. The method of claim 12, wherein said metallic bond coat is made of NiCrAlY.

14. The method of claim 12, wherein said ceramic top coat is made of Zirconia-8% Yttria.

15. A combustion apparatus for a gas turbine engine, comprising:

(a) a combustor structure including at least one combustion chamber;

(b) a dual cone fuel nozzle for injecting both fuel and water to said combustion chamber; and (c) a swirl cup package upstream of and adjacent to said combustion chamber, said swirl cup package including a swirler, a swirl cup, a splashplate and a venturi extending between said nozzle and said combustion chamber for mixing said fuel and water with air;

wherein a dense vertically cracked thermal barrier coating is applied to selected portions of said swirl cup package so as to prevent water erosion and hot corrosion.

16. The combustion apparatus of claim 15, wherein said dense vertically cracked thermal barrier coating has a porosity of less than approximately 8%.

17. The combustion apparatus of claim 15, wherein said dense vertically cracked thermal barrier coating has a tensile strength in the range of approximately 4–7 ksi.

18. The combustion apparatus of claim 15, wherein said dense vertically cracked thermal barrier coating is a segmented ceramic structure.

19. The combustion apparatus of claim 18, wherein macrocracks are produced within said segmented ceramic structure so as to be oriented substantially perpendicular to an interface of said selected swirl cup portion and said segmented ceramic structure.

20. The combustion apparatus of claim 15, wherein the portions of said swirl cup package selected for having said dense vertically tracked thermal barrier coating applied thereto is dependent upon having water impinge on said swirl cup package portions.

* * * * *